US010501242B2

(12) United States Patent
Licari

(10) Patent No.: US 10,501,242 B2
(45) Date of Patent: Dec. 10, 2019

(54) ORAL MOTOR DEVELOPMENT SIPPING SPOUT

(71) Applicant: Robert Licari, East Setauket, NY (US)

(72) Inventor: Robert Licari, East Setauket, NY (US)

( * ) Notice: Subject to any disclaimer, the term of this patent is extended or adjusted under 35 U.S.C. 154(b) by 0 days.

(21) Appl. No.: 13/851,175

(22) Filed: Mar. 27, 2013

(65) Prior Publication Data

US 2014/0291275 A1 Oct. 2, 2014

(51) Int. Cl.
*B65D 47/32* (2006.01)
*B65D 47/08* (2006.01)

(52) U.S. Cl.
CPC ..... *B65D 47/32* (2013.01); *B65D 47/0842* (2013.01)

(58) Field of Classification Search
CPC ..... B65D 47/32; B65D 2205/02
USPC ..... 215/307–315
See application file for complete search history.

(56) References Cited

U.S. PATENT DOCUMENTS 3,059,816 A * 10/1962 Goldstein ..... B65D 47/0842 215/235
3,727,789 A * 4/1973 Rieber, Jr. ..... B65D 43/022 220/367.1
4,838,441 A * 6/1989 Chernack ..... 215/216
6,170,719 B1 * 1/2001 Wilkinson ..... B01L 3/50825 215/235
7,328,820 B2 * 2/2008 Young ..... 222/484
7,591,393 B2 * 9/2009 Crudgington, Jr. .... B65D 47/40 215/388
8,511,492 B2 * 8/2013 Webster ..... B65D 47/06 215/216
2003/0192851 A1 * 10/2003 Ziegler ..... A61J 11/00 215/11.5
2007/0210093 A1 * 9/2007 Pinelli ..... A47G 19/2272 220/715
2011/0079570 A1 * 4/2011 Brown et al. ..... 215/11.4
2011/0284541 A1 * 11/2011 Webster ..... B65D 23/10 220/288
2012/0234789 A1 * 9/2012 Mason ..... B65D 77/28 215/229
2013/0221002 A1 * 8/2013 Chen ..... B65D 43/0212 220/200
2015/0298875 A1 * 10/2015 Dagnelie ..... B65D 47/12 222/465.1

* cited by examiner

*Primary Examiner* — Allan D Stevens
(74) *Attorney, Agent, or Firm* — Betsy Kingsbury Dowd; BKDowd Law, P.C.

(57) ABSTRACT

A drinking cap for a bottle includes a screwable drinking section for mating with screw threads of a bottle and a covering cap, hinged to the drinking section. The drinking section is provided with a cylindrical shaped spout of about ¼-¾ inches in height and about ¼-½ inch in outside diameter, all to enhance normal oral motor development and physiological development of a person's mouth. An air vent and air connecting air channel provided to the drinking section so that a drinker's lips, even if covering the opening of the air vent, will not block the passage of air into the cavity of the bottle to which the device is attached, ensuring no negative air pressure therein due to sucking. Mechanisms are provided for preventing leakage, ensuring free, easy flow of fluid when sucking is initiated, and ensuring safety to a child using or near the device.

11 Claims, 9 Drawing Sheets

ORAL MOTOR DEVELOPMENT SIPPING SPOUT

FIELD OF THE INVENTION

The present invention relates to an improved cap for a container holding liquid for human of any age for their consumption. The preferred embodiment of the preferably plastic cap for bottles is designed for young children or someone of decreased drinking ability to be used while learning to drink out of a cup or bottle at any age. The common vessels used today for teaching children to drink liquid out of a container is a Sippy cup, which is generally spill-proof while allowing a child to withdraw the liquid from the container by inappropriately using their tongue to create a force of suction on, and essentially pulling the liquid up through, the spout. The cavity of the cup holds the liquid and the cap of the cup generally covers most of the cavity with an upwardly extending wide spout on one side or possibly a sport cap. The spout is upwardly extending and has a hole in it. The child will place his/her lips around the spout and with the cup upended and using previously mentioned sucking action liquid will pour out of the cavity, through the hole of the spout and into the mouth of the child.

The present invention discloses a new and improved cap for such and other liquid containers, for example for a bottle filled with water, milk or juice, which can enhance oral motor development for young children and not negatively impact on the development of oral motor skills and physiology as the prior art spouts and mouthpieces. The mouthpiece of the present invention is designed to provide optimum movement of the lips, tongue, jaw, teeth, and palates of a young child, which in turn can lead to improved oral motor development, both physically and for proper and complete speech development. Other embodiments of the present invention enable use of the inventive lid on many other types of liquid containers, i.e., not merely bottles (glass or plastic) for example, Tetra Packs/boxes, juice/liquid pouches, cans, small bottles of plastic in the traditional soda/water bottle configuration, cups, glasses (plastic or glass), etc. while still maximizing oral motor skill development and physiology (physical development of jaws, teeth, mouth, lips, etc.) of a user.

BACKGROUND OF THE INVENTION AND DISCLOSURE

Most commonly used bottles for young children provide a top cap (not the spout cover to prevent spillage) that allows a child to drink the liquid located in the bottle or vessel (herein collectively referred to as "a bottle") by creating suction on the cap spout (or nipple in the case of bottles for infants) with their lips and tongue and with the bottle slightly inverted, i.e., with the liquid above the level of the hole of the spout or nipple so that liquid flows by gravity. The shape of the top cap, lid, sportcap or spout, however, can, if not appropriately provided, reinforce abnormal tongue movement, lip development, tooth structure, the action of sucking, etc., which in turn can lead to long term physical issues and possible also result in speech impediments. The present invention provides a new spout, lid or cap (collectively referred to as "spout") for such bottles, designed specifically for young children, disabled population or person with decreased oral motor ability, which includes an inventive cap that not only minimizes abnormal physiology of the mouth, reduces speech impediments and abnormal oral motor skill but actually affirmatively promotes oral motor development. Additionally, cups cans, bottles (soda, for example) even if used by adults with similar lids and spouts can cause oral or dental problems for a user's jaw, teeth, or lips so that the present invention has applicability thereto.

The present inventive spout, a simple cap element for a bottle of any type, be it baby bottle or water/soda bottle for adults, provides a simple to make, inexpensive mouthpiece for allowing removal of liquid on demand (inverted bottle vis a vis the opening) which, in the preferred embodiment, is preferably substantially rounded to match the shape of a young child's mouth during the early child developmental progression for anatomical formation. Contrarily, an oval-shaped or oblong spout or mouthpiece, like those seen in standard Sippy cups and commercially available spouts/sportcaps for bottles, nipples, spouts, drinking devices for children, can promote improper mouth formation and structure (teeth, gums, lips, etc.) and may thus cause speech issues (impediments and difficulty in communication) as children develop. Traditional spouts and nipple shapes also can lead to abnormal movement of the tongue, which can also lead to speech disorders. A substantially smooth wall, round-shaped spout for the vessel, bottle or cup allows a child, needing to sip liquid there through, to place his or her mouth over the spout without altering the natural shape and structure of the mouth. Use of this new spout will lead to oral motor development in the manner nature allows, will lead to oral motor development and will not impede nor impact on proper physiological development and that of oral motor skills Significantly, the present invention will advance the proper formation and development, physically and motoricly, while still, of course, providing a spout for a bottle for a child or person with oral motor dysfunction to enjoy the necessary act of drinking, whether for quenching thirst or to gain nutrition.

Optimally, in the preferred embodiment of the present invention, the spout comprises a length of a cylinder (i.e., cylindrical extension above the otherwise mostly flat surface of the cover of the majority of the cavity of the bottle) of approximately ¼ inch to ¾ inch long, and with a diameter of approximately ¼ inch to ½ inch across. These measurements are designed to fit within the circumference and the depth of a young child's developing mouth, without creating abnormal movement patterns or detrimentally affecting the structure and growth/development of the child's lips, gums, jaw, teeth, or tongue. A cylindrical spout which is either longer or wider than the optimal lengths presented by the preferred embodiment of the present invention can cause abnormal tongue movement (if the spout extends too deeply into the mouth of the child) or cause the jaw to open and close in an abnormal movement pattern or otherwise contact growing mouth structures and/or impact on normal growth and development. For example, a spout which uses abroad oblong mouth-contacting spout, which is common in the art, requires a child/user to extend his or her lips around the outer circumference of the spout which is unnatural for the forming anatomical O-like initial shape of one's mouth as a child. As a result, an abnormal movement pattern of the mouth's structures and tongue inhibit the oral motor development necessary for speech production and safe drinking.

Alternatively, a spout which is shorter than that presented by the preferred embodiment of the present invention can cause the lips of the child using the cup to be pressed against the base of the top of the cover/lid. This can lead to the lips of the child (or the fingers depending on the method by which the cup is being held) to block the air vent into the cup and can also impact on both physiological development and/or proper oral motor skills Without a channel or pathway for secondary air flow into the cup, the suction by a child will not release liquid from the cup, which in turn may cause a child to attempt to provide an excess of suction, thus harming his or her tongue, lips and/or cheeks. Again, over time and usage, this can be detrimental to both development of the child's mouth formation and to long-term oral motor skills, communication and development. Accordingly, it is another aspect of the present invention to provide an air vent on the base of the spout on this inventive cover or lid for a bottle proximal to the newly formed and inventive oral motor spout. The pathway or air vent 18, as shown in FIG. 1 is placed within a recessed air channel 20, which preferably runs across the diameter of the entire lid or at least from the opening 19 of the air vent 18 to an edge of the lid. This air channel 20 is preferably recessed within the profile of the lid, but is preferably narrow enough that a finger of the child using the present invention cannot get inside the channel and block the flow of air. This air channel ensures the constant flow of air and thus prevents the scenario discussed above, where a child may accidentally stop the flow of liquid via suction or the blockage of an additional air vent with his or her lips, facial features or fingers, thereby creating excessive suction through the spout and preventing any air from entering the inner compartment of the cup and forcing the liquid up through the spout or blocking the flow of liquid out of the spout. The opening 19 of the air vent 18 is then preferably recessed within the air channel, further ensuring that a child's finger or lip/facial feature cannot fit within the groove of the air channel 20 and within the air vent 18 to block the flow of air into the inner compartment of the cup.

In one embodiment, still referring to FIG. 1, the air channel 20 is preferably recessed across the diameter of the lid which maximizes the space 21, adjacent the opening 19 of the air vent 18, for the air flow into the air vent 18. By running across the diameter of the lid, the space 21, which is recessed below the top planar surface 30, in which air can flow to the air vent opening 19 is maximized. The air vent is then preferably further recessed within the air channel, preferably in the center of the air channel. It is envisioned in other embodiments that the air channel can exist in other shapes and locations on the top of the base of the lid, while still being recessed within the horizontal planar profile of the base, and with the air vent further recessed therein. Utilizing this design, with the recessed air channel and further recessed air vent, the present invention prevents or reduces blockage of air flow irrespective the location of the air channel and air vent on the lid.

The present invention or spout and integrated cap for a bottle is preferably provided with screw threads which mate onto the screw threads of a bottle, can, vessel, or container having a liquid-holding cavity within its base for holding liquid and facilitating drinking when slightly or fully inverted. The cap comprises a set of internal screw threads beneath its planar surface which mate with a corresponding set of threads (in shape, size, pitch, etc. of external screw threads on the cavity portion of the bottle, i.e., on the container's base. This allows the cap with integrated spout to be turned or screwed on with respect to the base or cavity of the bottle and attached thereto by interconnection of the screw threads. This preferable construction tends to prevent leakage of any liquid from the cap, as the screw thread combination creates a tight seal around the circumference of the bottle so that substantially no liquid contained therein will spill out of the sides of the bottle (over the side wall) even when the bottle with cap is twisted, turned, or shaken by a child.

As mentioned, in other embodiments of the present invention, the present inventive lid and integrated spout for a child's bottle can be utilized with other liquid containers for users of all ages, while still providing the same structural optimizations, benefits, etc., for human development and oral motor skills.

DESCRIPTION OF PRIOR ART

To the Inventor's and Applicant's knowledge, no prior art exists which utilizes the structural combinations disclosed by the present invention for use in a lid and an integrated non-spill spout for a bottle, vessel, or drinking cup. Namely, no prior art exists which utilizes a drinking spout on the lid for a bottle, cup, vessel, holding chamber, etc. or any liquid container having a holding cavity for drinkable liquid which comprises a smooth-walled, substantially cylindrical-shaped (or frusto-conical, like a nuclear power cooling tower) spout for accepting the lips of the drinker (any age or drinking ability) with a limited length of about approximately ¼ inch to ¾ inch long in projection above the planar surface of the lid and a diameter across the top, at the end of the spout, of approximately about ¼ inch tot/2 inches. This configuration tends to maximize oral motor development and minimizes complications of inhibiting proper physiological and motor development of the mouth. The present invention further comprises a recessed air vent set within a recessed air channel to prevent lip/facial feature or finger blockage of air to prevent build up of negative pressure in the cavity due to suction and tends to maintain the free flow of the liquid from the container through the spout to the user. The combination of these features or aspects is new and inventive. The precise measurements of the spout 16 are directed to maximizing oral motor development and preventing or minimizing physical and speech development issues from arising, while the recessed air channel 20 with further recessed and connected air vent 18 will help to ensure that air flow into the container occur while allowing liquid to easily and uniformly flow out and allow a more natural swallowing pattern for the drinker when the container/bottle is inverted such that the opening 22 of the spout 16 is located below the liquid within the cavity of the bottle. The air flow system, channel and vent connect the ambient air to the inside of the cavity of the bottle and allow for continuous air flow and ensure that liquid flow is maintained even if the user extends their lips over the opening 19 of the air vent 18, i.e., it reduces the pressure differential between inside and outside air by ensuring that the air channel 20, recessed and connected to the air vent 18, is unblockable by lips and fingers, and will maintain a free flow of air to the inside cavity of the bottle.

SUMMARY OF THE INVENTION

The present invention relates to a new lid and spout for a bottle or other liquid vessel. It is preferably a screw-on lid but, of course, can be snap-on or permanent, too. The interior screw threads of the lid are meant to mate with and screw on and over the exterior screw threads of liquid vessels, preferably bottles, cups, containers, cans, Tetra packs/boxes and juice/liquid pouches, etc. A safety cover is preferably provided with a safety mechanism (child-proof) which requires two independent mechanical actions to open the cover to expose the spout and top planar surface of the lid. A simple live hinge, a connecting piece of plastic (the entire device is intended to be molded from plastic) connects the safety cover to the lid of the vessel. In this manner the cover can be hinged from covering up the opening 22 of the spout of the lid and the opening 19 of the air vent 18 or hinged onto covering the opening 22 of the spout of the lid and the opening 19 of the air vent 18, as desired. It is expected that a young child cannot satisfy the two independent mechanical movements of the safety aspects of the cover vis a vis the lid to open the same. In the preferred embodiment, the cover has a flange which needs to be depressed and at the same time the cover rotated about the hinge to expose the spout and its opening. The flange, in the preferred embodiment is protected from inadvertent mechanical depression by a tamper proof break away tab.

The cover has a top and a bottom (or exterior and an interior). The interior of the cap is provided with a plastic ring and a rod or plug. The ring will seal over and close off the spout and the rod/plug (preferably tapered) will, when the cap is hinged over the lid, will seal the air vent in the lid.

The lid itself is provided with a simple air vent or opening through its thickness, i.e., an opening or passage from the top surface of the lid to the underside. This establishes an air passageway into the cavity of the container/bottle.

A cross passageway to the air vent 18 is also provided in the form of a channel 20, extending across the planar surface of the lid. It passes over and extends on either side of the recessed-from-the-planar-surface opening 19 of the air vent 18, as shown in FIG. 1.

It ensures that even if the mouth of the child and lips extend over the air vent, the air channel 20 extending on either side of the air vent 18 to the side wall(s) of the lid will still provide a continuous passageway of air or air channel so that a flow of air will always be present from the outside ambient air of the bottle to the inside cavity of the bottle, precluding negative pressure from building up on the inside of the bottle.

The spout for the lid is quite important, too. It projects upwardly from the top plane defined by the lid and is preferably cylindrical although at its base or connection point to the lid, may be slightly tapered outwardly for ease of molding and to ensure long term usage without degradation. The cylindrical or frusto-conical shaped spout (like the shape of a cooling tower at a nuclear plant) has a central opening, a hole, defining the open end of the channel within the cylinder and through which the liquid shall flow when a child's mouth is placed over the spout. Preferably, the spout has a smooth outside wall for ensuring the child's lips easily and without risk of injury seal around the spout to ensure also absence of liquid spillage. The dimensions of the height of the spout are quite specific, intended to promote proper oral motor growth, not to inhibit the same, and to ensure minimization of oral motor development abnormalities and speech deficits. The height of projection of the spout and its outside diameter are considered important to the present invention.

DETAILED DESCRIPTION OF THE INVENTION AND THE PREFERRED EMBODIMENT

It will be understood by those of ordinary skill in the art that various changes may be made and equivalents may be substituted for elements without departing from the scope of the invention. In addition, many modifications may be made to adapt a particular feature or material to the teachings of the invention without departing from the scope thereof. Therefore, it is intended that the invention not be limited to the particular embodiments disclosed, but that the invention will include all embodiments falling within the scope of the claims.

Figure 3:
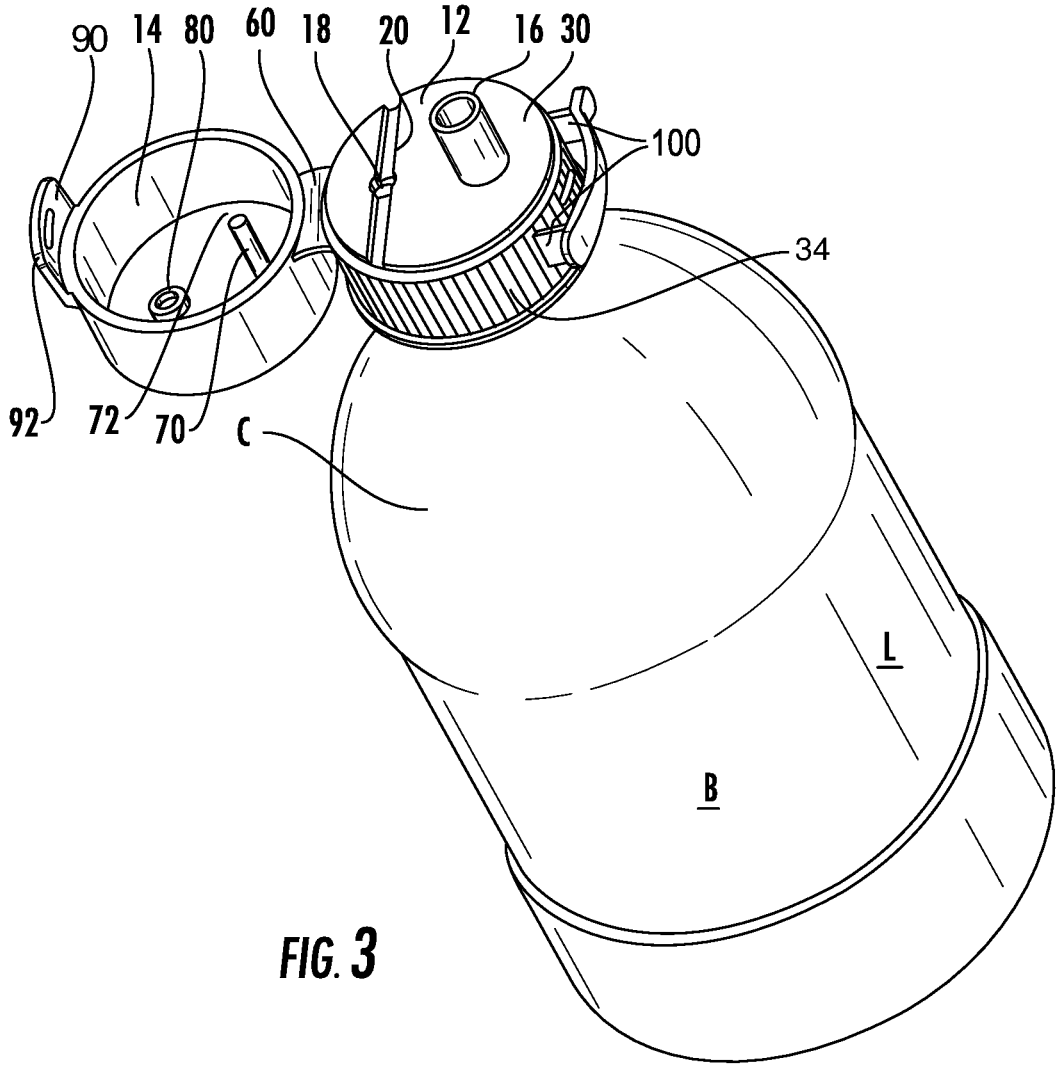
FIG. 3 perspective view of the present invention shown on a bottle, with the outside wall of the lid having knurlings to facilitate the placement and removal of the device on a screw threaded bottle (shown in phantom)
Figure 4:
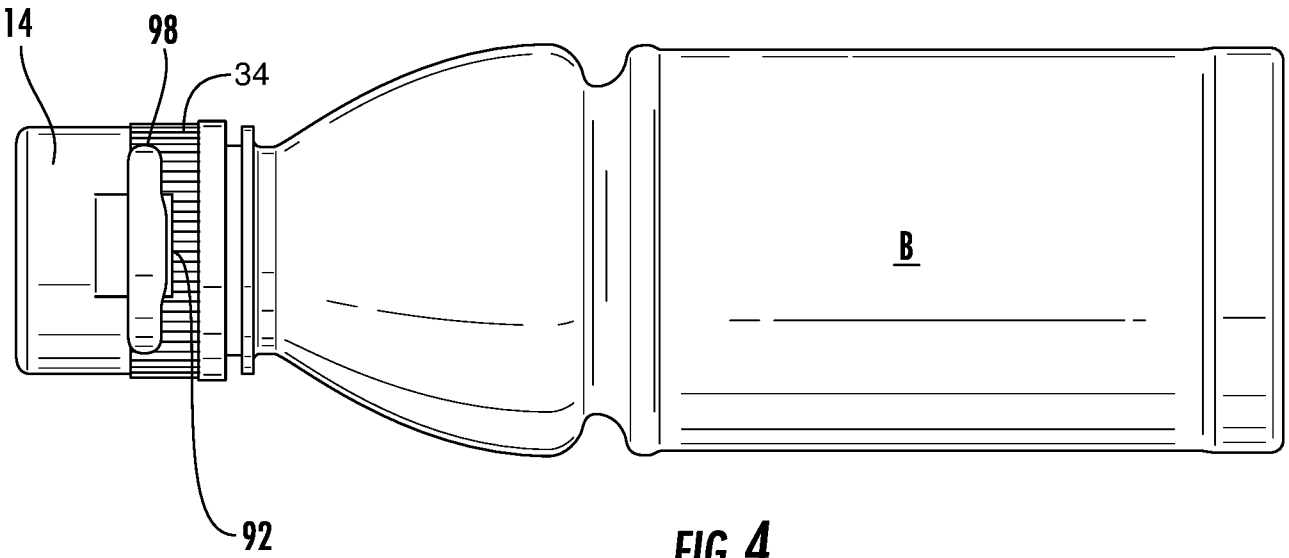
FIG. 4 is a side perspective view of the bottle shown in FIG. 3 and the device shown in FIGS. 1, 2, and 3, with the cover of the device over the lid.
Figure 5:
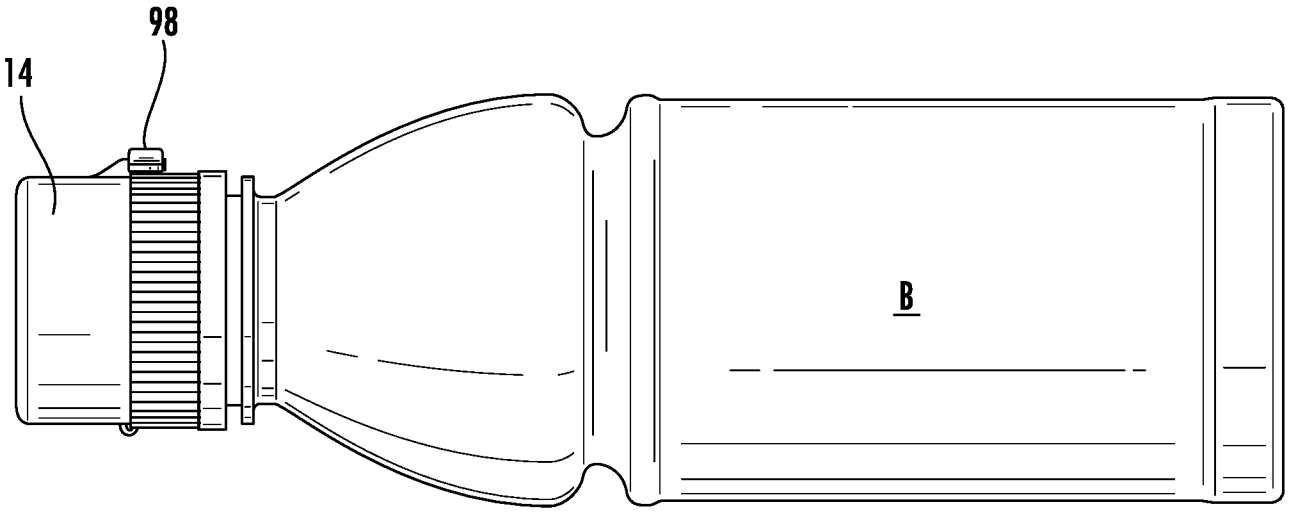
FIG. 5 is a view of the device similar to that shown in FIG. 4 but showing the bottle rotated about 90 degrees about its vertical axis to show the cap and lid, i.e., the device of the present invention, shown from another view and perspective.
Figure 6:
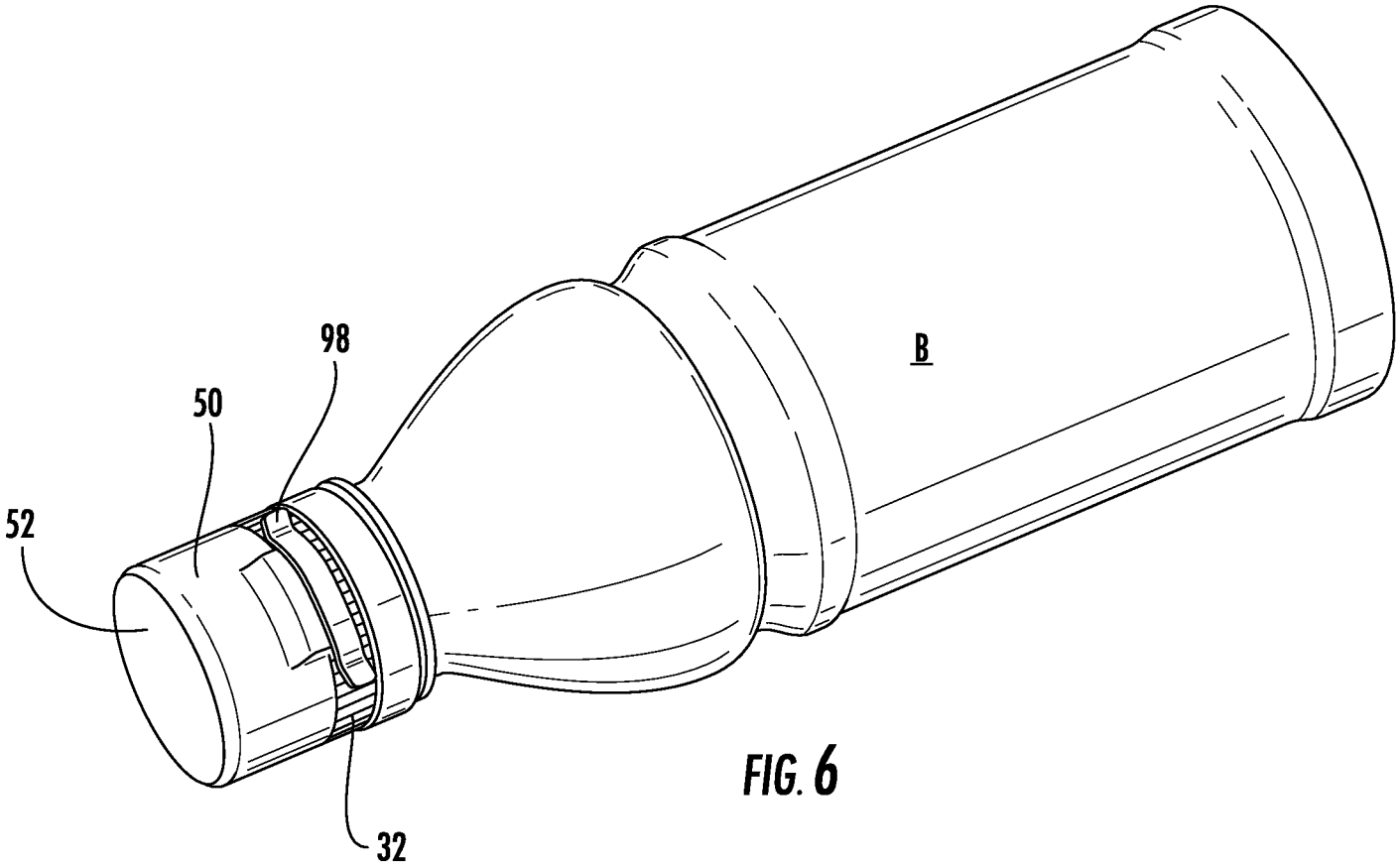
FIG. 6 is a perspective view of the invention on a bottle, as shown in FIG. 4.
Figure 7:
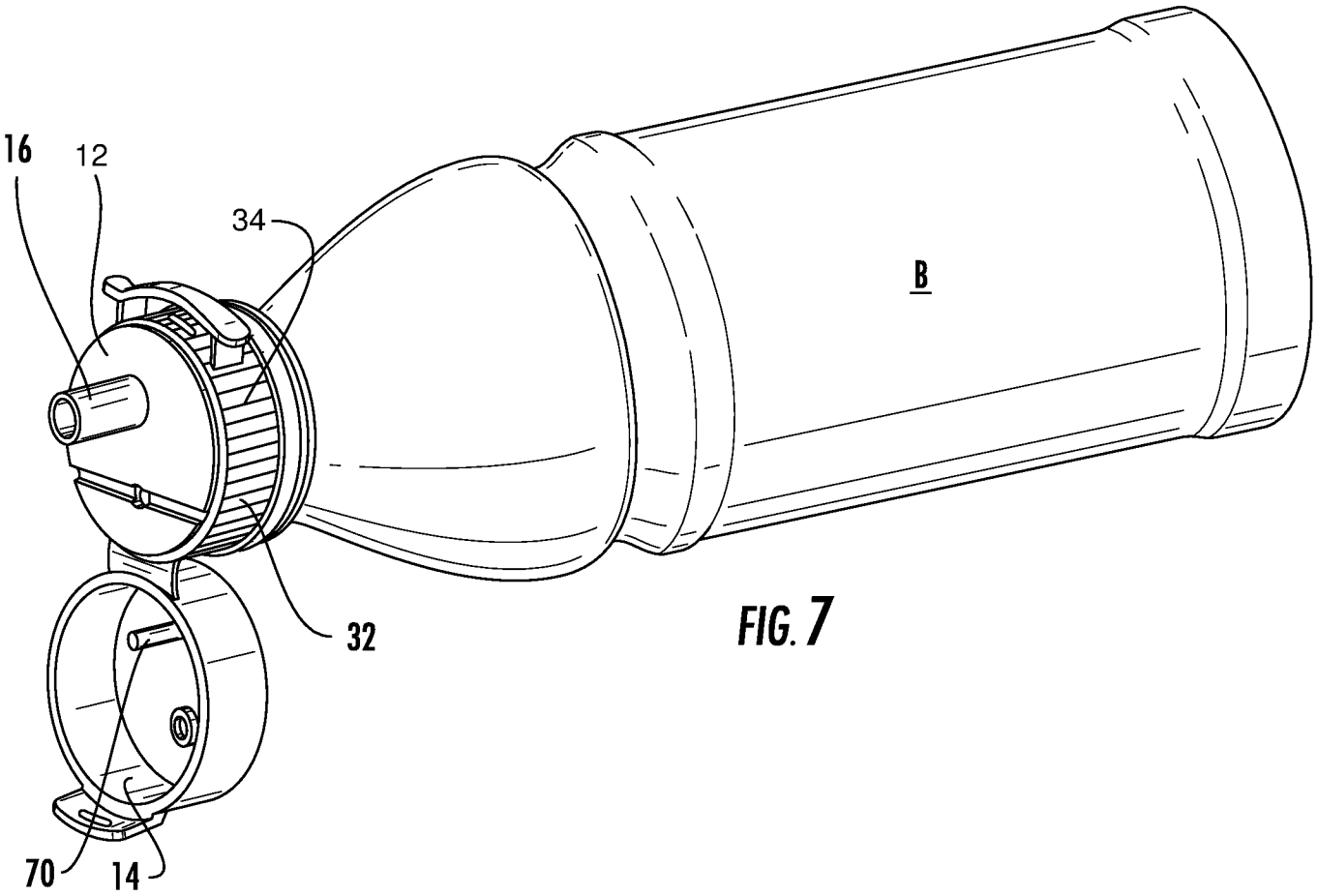
FIG. 7 is a view similar to that of FIG. 6 but showing the cover of the device unhinged or opened from closing off the lid and spout of the invention.
Figure 8:
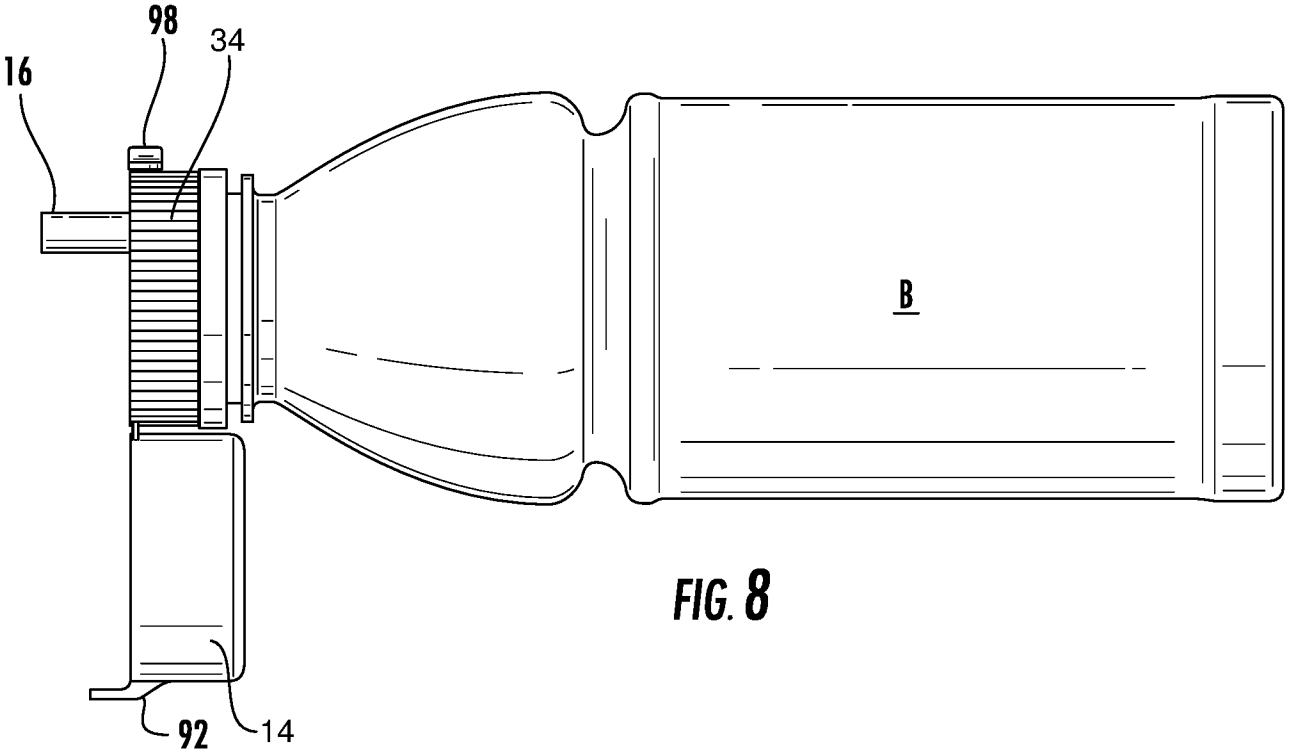
FIG. 8 is a side perspective view similar to that of FIG. 5 but showing the cover in its position (unhinged) when the cover does not close off the spout nor the air vent, i.e., in the orientation of the device when the liquid can flow by sucking and inverting the bottle so that the spout is below the level of the liquid drinking fluid in the bottle.
Figure 9:
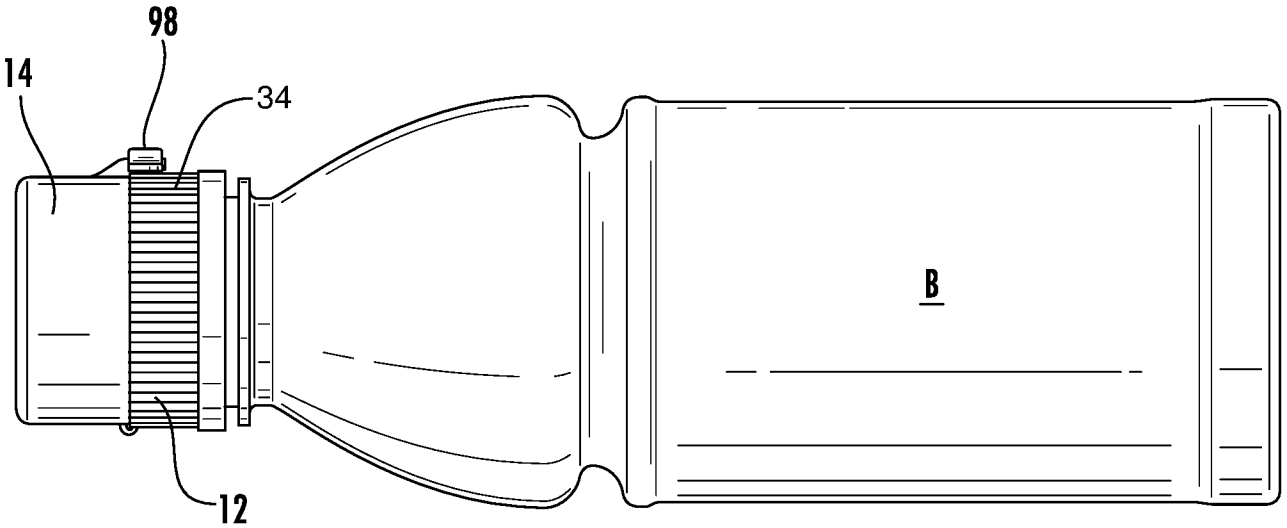
FIG. 9 is a side view of the device shown in FIG. 8 with the cover closing the spout and air vent, in the orientation of the device when the bottle with device is desirably transported.

The device 10, a drinking cap or spout device for a bottle is intended for use by a child but, of course it can be dimensioned for an adult too. The drinking section 12 of the device comprises a flat planar surface $\mathbf{30}^1$ and a circumferential wall 32. The outside surface of the circumferential wall 32 can be provided with a set of knurled ridges 34 which facilitate the easy thumb and forefinger gripping of the device 10 to place the same onto and remove, as desired, the device from a bottle B (see FIG. 3) by the interior screw threads 40 of the underside of the device 10 matingly engaging exterior screw threads knot visible) of the bottle B.

The planar surface $\mathbf{30}^1$ of the device 10 connects the circumferential wall 32 to the top surface of the device 10.

The planar surface 30 of the device 10 connects the outside circumferential wall 32 to the top surface of the device 10. Passing through the planar surface 30 are: a through-hole that forms an air vent 18; and a spout 16. Spout 16 is preferably cylindrical in shape, possibly frusto-conical. As a spout 16, it has a central bore 24 passing therethrough and an opening 22 at the end of the central bore 24. The opening 22 of the spout 16 is preferably about ¼ of an inch to ¾ of an inch in height above the planar surface 30. In the preferred embodiment, the outside diameter of the spout 16 is in the range of about ¼ to ½ of an inch with the thickness of the wall of the spout 16 in the range of about 1/16 to ⅜ of an inch.

Passing through the planar surface 30 of the drinking section 12 is an air vent 18. It provides fluid communication between the inside cavity of the bottle B and the ambient air.

An air channel 20 is provided to, to facilitate the free flow of air from outside the cap to the cavity of the bottle B so that no negative pressure builds up, hampering the free flow of liquid as desired.

The air channel 20 crosses the opening 19 of the air vent 18 and is recessed below the planar surface 30 of the drinking section 12. Preferably the air channel 20 extends across a chord of the planar surface 30 but it can also extend to one side, alone. In the preferred embodiment, the air channel 20 extends from one indented edge 59 of the planar surface 30 to the other side and indented edge 59. The air channel 20 is recessed below the top or planar surface 30 and is in fluid communication with the air vent 18. The air vent 18 and the air channel 20 are spaced apart from the spout 16 so that the small lip or facial feature of the drinker sucking on and over the spout 16 will not cover and block the air vent 18 and air channel 20. However, even if the drinker extends their lips over the air vent 18, the recessed air channel 20 will still allow for the free flow of air from outside the bottle B to within the cavity of the bottle, so that no negative pressure is built up within, by the sucking of the drinker on the spout 16.

Preferably the air channel 20 is about ⅛ to ¼ inches in width and the amount of recess is about 1/16 to ⅛ of an inch below the planar surface 30. Preferably the air vent 18 is about 1/16-½ inch, center of central bore 24 of spout 16 to center of bore 44 of the air vent 18, with a variation of about ¼ inch.

Figure 1:
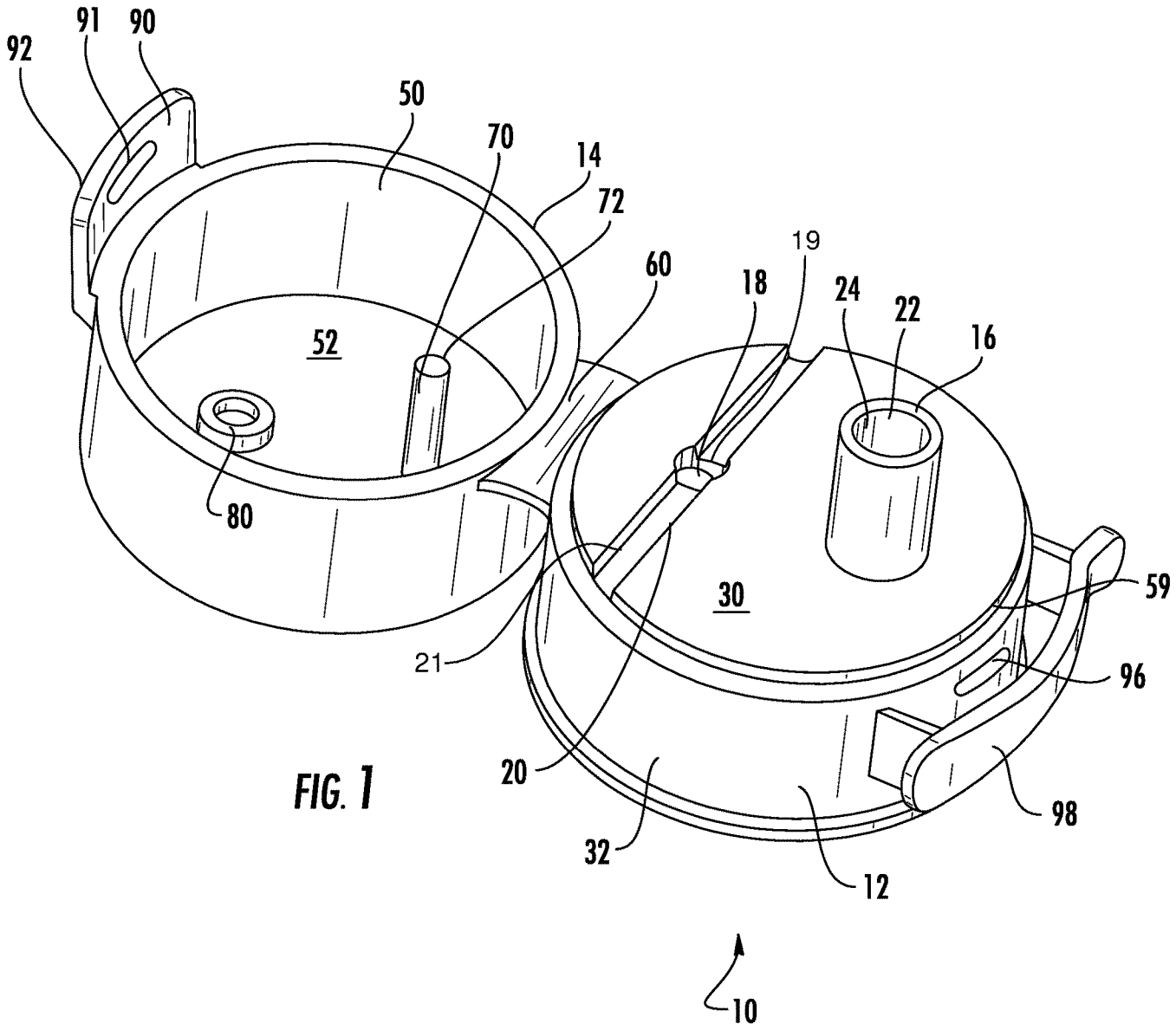
FIG. 1 is a perspective view of the present invention, with the cap shown with the cover open (and showing the bottom of the cover) and the top of the lid, with open spout shown, too.
Figure 2:
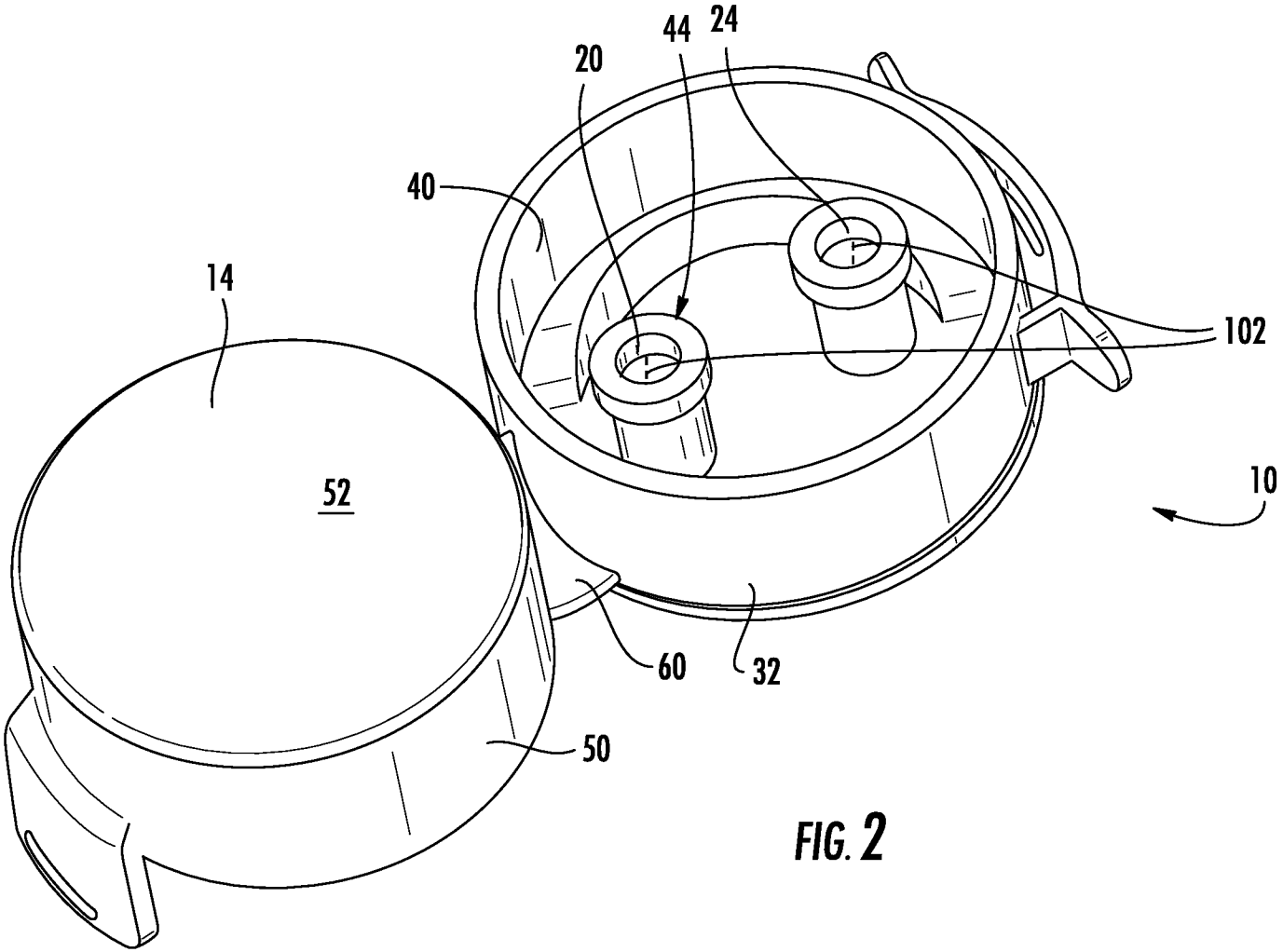
FIG. 2 is a view similar to FIG. 1 but showing the device turned over and thus showing the top of the cover and the bottom of the lid.

The inside of the covering cap 14 is shown in FIG. 1. The covering cap 14 has a cylindrical wall 50 and a flat surface 52. The inside diameter of the cylindrical wall 50 closely matches the outside diameter of the indented edge 59 portion of the circumferential wall 32 of the drinking section 12. The drinking section 12 and the covering cap 14 are connected together by a small, flexible live hinge or plastic web element 60. The hinge 60 allows the cap 14 to be easily placed over and removed from the drinking section 12.

The inside of the covering cap 14 is provided with a downwardly extending (when the cap is on the drinking section) rod element 70. It is meant for the end of the rod 70 to closely fit within the bore 44 of the air vent 18. The rod 70 extends from the flat surface 52 of the cap so that the closed tip or end 72 of the rod 70 fits within and closes off the air vent hole 18, when the cap 14 is hinged over and superimposed over the drinking section 12.

Secured within the cap 14, on the inside surface thereof, i.e., on the inside of flat surface 52 is an aligned rubberlike sealing ring 80. The sealing ring 80 is resilient, like an O-ring, and when the cap 14 is placed over the drinking section, the sealing ring 80 will be thrust against and over the opening 22 of the spout 16. In this manner, if the bottle with the device 10 is inverted, with the cap closed, only a very, very small amount of fluid can leak from and through the opening of the spout into the small cavity defined within the sealing ring 80 and the flat surface 52 of the cap.

If desired, the bottom of the air vent 18 and the bottom of the central bore 24 of the spout 16 can be provided with flexible x-slit membranes which allow for liquid flow (air and liquid) only if suction is on the spout 16. Alternatively, the membranes can be simply split along their diameters.

The cap and drinking section can also be provided with a safety mechanism 90 having a resilient flange 92 with extension tab 91[1] cooperating with a similarly shaped recess 96 around the circumferential wall 32 of drinking section 12. The recess 96 is superimposed by a removable protective surface tab 98 which extends away from the circumferential wall 32 by two opposed legs 100. Of course, many other mechanical safety interlocks can be used without departing from the present invention.

In use, the device 10 is capable of being screwed onto a bottle from a supply of the same in one's home for re-use or the device can be initially bought from the store with a full integration of the device on a bottle. When purchased the cap is closed, i.e., the covering cap 14 is overlying and closes off the drinking section 12 and the spout 16, air vent 18 and air channel 20. When a drink or liquid L is desirably dispensed from the cavity C of the bottle B, the bottle B is first opened by removing the cap 14 from the drinking section 12 by flipping the cap 14 about the horizontal hinge axis of hinge 60 so that the bottle B and the device evidence the orientation shown in FIG. 3. Then, inverting the bottle B so that the liquid L is above the opening 22 of spout 16 (or the spout is below the liquid L in the bottle B) will cause liquid L to be capable of being sucked through the flexible membrane 102 on the bottom of the spout as the child sucks on the spout 16. This allows for easy fluid flow. If, however, the child's lips cover the air vent 18, the air channel 20 will still allow air from the environment to gain access to the cavity to prevent the build up of negative pressure within the cavity. The resiliency and ease of air flow through the channel and the air vent are greater than that of the flow of liquid through membrane 102 covering the inside of the central bore 24 of the spout 16 so that air passage into the bottle B occurs and builds air pressure inside the vessel which overcomes the friction of the membrane and ejects liquid out of the bottle B. The passage of fluid or liquid out of the bottle B will only occur when an actual sucking is provided on the spout.

When the drink is completed, the cap 14 is rotated about the hinge 60 to block the spout by the sealing ring 80 and the air vent by the rod 70 (tip 72 covering the air vent).

If the device is desirably removed for allowing the same to be installed onto another bottle B or for washing of the same, it is a simple matter to remove the same by grasping the knurled ridges 34 and rotating the device 10 with respect to the held bottle B.

The child proofing safety mechanism 90 operates in a manner quite similar to others, namely, ensuring that opening of the fluid conduit only occurs by those with sufficient manual dexterity (and presumed understanding of the concepts of spilling) and closing of the same by hinging and rotating the cap about the hinge until the extension tab 91 of the flange 92 of the cap cover 14 is within the corresponding recess 96 of the drinking section 12, safely held beneath the covering piece 98.

It will be understood by those of ordinary skill in the art that various changes may be made and equivalents may be substituted for elements without departing from the scope of the invention. In addition, many modifications may be made to adapt a particular feature or material to the teachings of the invention without departing from the scope thereof. Therefore, it is intended that the invention not be limited to the particular embodiments disclosed, but that the invention will include all embodiments falling within the scope of the claims.

I claim:

1. A device for facilitating the natural drink/swallow pattern of a young child for liquid from a cup or bottle and for improving the oral motor developmental skills and the physiological development of a young child's mouth comprising:

a drinking section in the form of a covering for a cup or bottle, said drinking section comprising a planar top surface and a spout secured to and projecting upwardly from said planar top surface, wherein said planar top surface defines a top surface of said drinking section;

wherein said spout is cylindrical in shape with a central bore therethrough, said spout having a uniform spout length of only about ¼ to ¾ inches in length above said planar top surface and a uniform outside diameter of said spout in a range of about ¼ to ½ inches;

wherein said device further comprises an air vent extending downward through a thickness of said drinking section, and an air channel that extends across and ends at opposing edges of said top surface, wherein said air channel is in the form of a groove extending across and recessed into said top surface of said drinking section, wherein said groove is spaced apart from said spout, and wherein said air vent is positioned within said groove such that an opening of said air vent is recessed in said groove below said planar top surface, said groove thereby connecting ambient air to said air vent during use.

2. The device as claimed in claim 1 further comprising a closing cap, said closing cap including a sealing ring on its bottom to close off said spout when said closing cap is closed over said spout thus preventing accidental leakage of liquid from said cavity.

3. The device as claimed in claim 2 further comprising a living hinge connecting said closing cap to said drinking section.

4. The device as claimed in claim 1 further comprising a closing cap, said closing cap comprising a rod with a tip which is configured to poke into and close off a central bore of said air vent when said closing cap is closed over said air vent.

5. The device as claimed in claim 4 wherein said rod extends down from a bottom of said closing cap of said device.

6. The device as claimed in claim 1 wherein said spout is provided with a flexible membrane which only opens to allow flow of the liquid from the cup or bottle when sucking is provided to said spout.

7. A device for facilitating the natural drink/swallow pattern of a young child for liquid from a cup or bottle for improving the oral motor developmental skills and the physiological development of a young child's mouth comprising:

a drinking section in the form of a covering for the cup or bottle, said drinking section comprising a planar top surface, and a spout secured to and projecting upwardly from said planar top surface, wherein said planar top surface defines a top surface of said drinking section;

wherein said spout is cylindrical with a central bore therethrough, and has a uniform spout length;

wherein said device further comprises an air vent positioned proximate said spout and extending downward through a thickness of said drinking section; and an air channel that extends across and ends at opposing edges of said top surface, wherein said air channel is in the form of a groove extending across and recessed into said top surface of said drinking section, wherein said groove is spaced apart from said spout, and wherein said air vent is positioned within said groove such that an opening of said air vent is recessed in said groove below said planar top surface, said groove thereby connecting ambient air to said air vent during use.

8. The device as claimed in claim 7 wherein a wall thickness of said spout is in the range of about 1/16 to ¼ inches.

9. The device of claim 7, wherein a width of said groove is from ⅛ to ¼ inch.

10. The device of claim 9, wherein said groove is recessed about 1/16 to ⅛ inch below said planar top surface.

11. The device of claim 7, wherein said groove extends along a chord of said planar top surface.

* * * * *